US009049890B2

(12) United States Patent
Starr et al.

(10) Patent No.: US 9,049,890 B2
(45) Date of Patent: Jun. 9, 2015

(54) TAN-THROUGH SPORTS BRASSIERE

(71) Applicant: Naked Sports Gear, Inc., Brooklyn, NY (US)

(72) Inventors: Reilly Stratton Starr, New York, NY (US); Katherine Sue Nicklos, Astoria, NY (US)

( * ) Notice: Subject to any disclaimer, the term of this patent is extended or adjusted under 35 U.S.C. 154(b) by 306 days.

(21) Appl. No.: 13/645,403

(22) Filed: Oct. 4, 2012

(65) Prior Publication Data

US 2013/0084777 A1 Apr. 4, 2013

Related U.S. Application Data

(60) Provisional application No. 61/543,029, filed on Oct. 4, 2011.

(51) Int. Cl.
*A41C 3/00* (2006.01)

(52) U.S. Cl.
CPC ..... *A41C 3/0057* (2013.01); *A41D 2400/28* (2013.01)

(58) Field of Classification Search
CPC ..... A41C 3/005; A41C 3/10; A41C 3/14; A41C 3/142; A41C 3/144; A41D 7/00; A41D 7/006; A41D 13/0017; A41D 2400/28; A41D 2400/62; A41D 2400/60; A41D 3/0085; A41D 3/0057; A41D 3/0014; A41D 27/20; A41D 31/02
USPC ..... 450/54, 36, 1, 44; 2/105, 106, 113, 115, 2/67, 69, 114, DIG. 1
See application file for complete search history.

(56) References Cited

U.S. PATENT DOCUMENTS

| | | | | |
|---|---|---|---|---|
| 4,217,905 | A * | 8/1980 | Atwater et al. | 450/74 |
| 4,458,684 | A * | 7/1984 | Frankel | 450/53 |
| 4,546,493 | A | 10/1985 | Bortnick | |
| 4,583,544 | A | 4/1986 | Flanagan et al. | |
| 4,804,351 | A * | 2/1989 | Raml et al. | 450/58 |
| 4,813,081 | A * | 3/1989 | Cliff et al. | 2/115 |
| 4,996,723 | A * | 3/1991 | Huhn et al. | 2/105 |
| 5,702,285 | A * | 12/1997 | Orlando | 450/1 |
| 5,987,933 | A | 11/1999 | Metzler | |
| 6,174,217 | B1 * | 1/2001 | Judson | 450/1 |
| 6,276,176 | B1 | 8/2001 | Blakely | |
| 7,024,892 | B2 | 4/2006 | Blakely | |
| 8,555,414 | B2 * | 10/2013 | Davis et al. | 2/69 |
| 2004/0098784 | A1 * | 5/2004 | Desai | 2/69 |
| 2005/0060792 | A1 * | 3/2005 | Desai | 2/403 |
| 2010/0240280 | A1 * | 9/2010 | Michel | 450/39 |
| 2012/0282844 | A1 * | 11/2012 | Salguero | 450/31 |
| 2013/0084777 | A1 * | 4/2013 | Starr et al. | 450/86 |
| 2014/0134922 | A1 * | 5/2014 | Hearty | 450/31 |

* cited by examiner

*Primary Examiner* — Gloria Hale
(74) *Attorney, Agent, or Firm* — Mark Terry

(57) ABSTRACT

A sports brassiere designed for reducing tan lines is disclosed. The sports brassiere includes an exterior front panel comprising a micromesh fabric substantially transparent to ultraviolet light, wherein the exterior front panel is shaped to include two shoulder straps and two side seams, and an interior front panel including an opaque, moisture-wicking fabric having a height limited to covering breasts, wherein the interior front panel is coupled to an interior face of the exterior front panel via stitching running along a top edge of the interior front panel. The sports brassiere further includes an exterior rear panel of micromesh fabric coupled to the exterior front panel via a set of seams located at the shoulder straps and side seams and an elastic band coupled to a bottom edge of the exterior front and rear panels, and a bottom edge of the interior front panel.

19 Claims, 5 Drawing Sheets

TAN-THROUGH SPORTS BRASSIERE

CROSS-REFERENCE TO RELATED APPLICATIONS

This patent application claims priority to patent application No. 61/543,029, filed Oct. 4, 2011, and entitled "Sports Apparel That Reduces Tan Lines By Using Micromesh Fabric." The subject matter of patent application No. 61/543,029 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to the field of clothing and apparel, and more particularly relates to improved features for sports brassieres.

BACKGROUND OF THE INVENTION

The female breasts have very little internal support, being composed largely of adipose tissue or fat. The primary anatomical support for the breast is provided by the Cooper's ligaments, with the skin covering the breasts offering some additional support. However, this anatomical support is usually insufficient to hold the breasts up, and to prevent movement of the breasts, which can cause pain and discomfort. Thus, the primary reason for wearing a brassiere or similar foundation garment is to provide external support for the breasts, increasing comfort and mobility. Brassieres are also believed by some to help preserve the youthful shape of breasts, which naturally sag as women grow older.

A brassiere consists of a pair cups for the breasts, a center panel, and a horizontal band that protrudes from the side of each cup, wherein the bands extend around the wearer's torso and meet behind the wearer's back. Unless a brassiere is a strapless brassiere, it will also include a vertical shoulder strap protruding from the top of each cup. A brassiere, or bra, is typically made of a fabric such as cotton or lace, with the cups for the breasts given shape by underwires or plastic reinforcements. The horizontal bands are usually fastened behind the wearer's back using a hook fastener.

A sports brassiere, or sports bra, is a specialized brassiere that provides additional support to female breasts during physical exercise. A sports bra comprises more robust construction than standard bras, thereby providing extra support, minimization of breast movement, alleviation of discomfort, and reduction of potential damage to chest ligaments. Conventional sports bras can either encapsulate or compress breasts. Sports bras that encapsulate breasts have molded cups, while compression-type sports bras restrict movement and bounce by flattening the breasts against the chest. A common sports bra design resembles the design of a tank top with the bottom half cut off.

One problem with sports brassieres is that they cause well-defined tan lines. Since sports brassieres are usually worn while playing sports, which are often played outside in the sunshine, sports bras can cause unsightly tan lines in those areas most exposed to the sun—i.e., the shoulders and back. Tan lines caused by prolonged exposure to the sun can become sharply etched into the wearer's skin and are notoriously difficult to remove. This can be a problem for women, considering that tan lines caused by sports bras may be visible when the wearer dons a bathing suit, a strapless dress or other garment that displays the wearer's shoulders and/or back. Because conventional sports brassieres do not address this issue, women playing sports outdoors often resort to wearing bikini tops to minimize tan lines. This is not an adequate solution, however, since bikini tops are designed for sun bathing and not for providing breast support during sports play.

Therefore, a need exists to overcome the problems with the prior art as discussed above, and particularly for an improved sports brassiere that addresses tan lines.

SUMMARY OF THE INVENTION

Briefly, according to an embodiment of the present invention, a sports brassiere designed for reducing tan lines is disclosed. The sports brassiere comprises an exterior front panel comprising a micromesh fabric substantially transparent to ultraviolet light, wherein the exterior front panel is shaped to include two shoulder straps and two side seams, and an interior front panel comprising an opaque, moisture-wicking fabric having a height limited to covering breasts, wherein the interior front panel is coupled to an interior face of the exterior front panel via stitching running along a top edge of the interior front panel. The sports brassiere further comprises an exterior rear panel comprising the micromesh fabric, wherein the exterior rear panel is coupled to the exterior front panel via a set of seams located at the two shoulder straps and the two side seams and an elastic band coupled to a bottom edge of the exterior front panel, a bottom edge of the interior front panel and a bottom edge of the exterior rear panel.

In an alternative embodiment, the sports brassiere may further comprise an interior rear panel consisting of the opaque, moisture-wicking fabric having a height substantially lower than a height of the exterior rear panel, wherein the interior rear panel is coupled to an interior face of the exterior rear panel via stitching running along a top edge of the interior rear panel.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
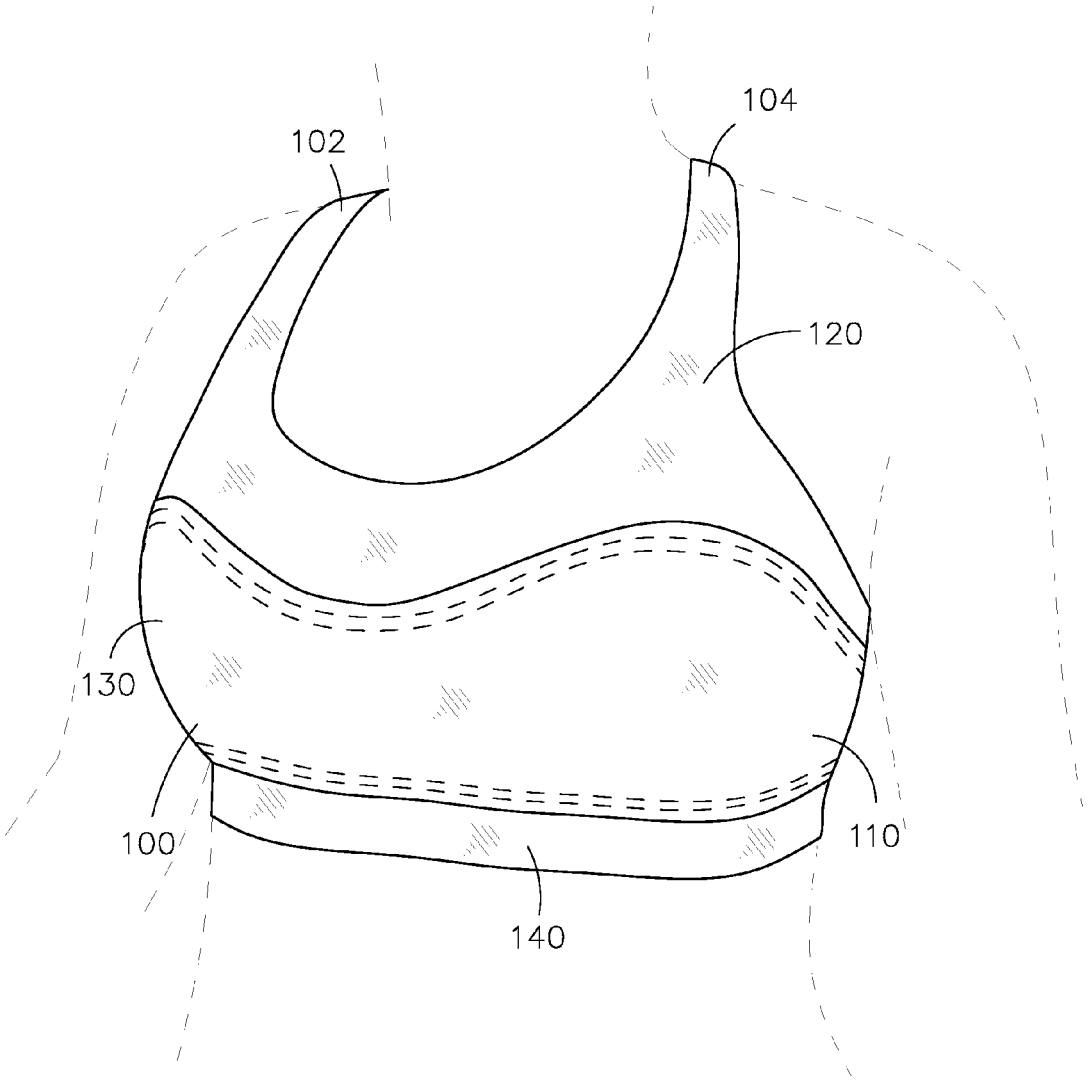
FIG. 1 is an illustration of a frontal view of the sports brassiere worn by an individual, in accordance with one embodiment of the present invention.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

In accordance with the embodiments described herein, a sports brassiere is disclosed that solves problems with the prior art by providing a brassiere that provides adequate support during sports, while at the same time reducing tan lines on the wearer's skin. The sports brassiere of the present invention utilizes a tan-through fabric that is substantially transparent to ultraviolet light, which causes tanning. The tan-through fabric is utilized in the sports brassiere on those areas most exposed to the sun—i.e., the shoulders and back—thereby reducing or eliminating tan lines. The sports brassiere of the present invention further utilizes an opaque fabric in those areas that are sensitive to light and/or cannot be exposed, such as the breasts, areolas and the nipples.

FIG. 1 is an illustration of a frontal view of the sports brassiere 100 worn by an individual, in accordance with one embodiment of the present invention. FIG. 1 shows a front panel 130 of the sports bra 100, wherein the front panel 130 comprises a continuous portion of tan-through fabric 120 that is shaped to include two shoulder straps 102, 104 and extends down to an elastic band 140, which is also covered by a portion of tan-through fabric. A lower portion of the front panel 130 further includes a portion of opaque fabric 110 that is disposed behind the tan-through fabric 120 so as to cover and occlude the breasts and nipples. Note the height of the opaque fabric 110 in the front panel 130 is lower than the height of the tan-through fabric 120 and that the height of the opaque fabric 110 is limited to covering the breasts and nipples of the wearer.

Figure 5:
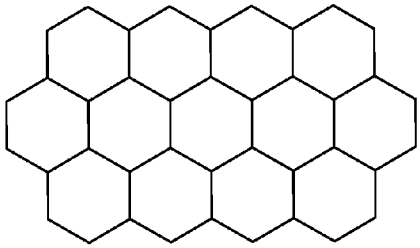
FIG. 5 is an illustration of a detail of a micromesh fabric, in accordance with one embodiment of the present invention.

The tan-through fabric 120 is substantially transparent to ultraviolet light thereby allowing sun light to tan the entire area of the wearer's shoulders and reducing or eliminating tan lines in the shoulder area. In one embodiment, the tan-through fabric 120 comprises a four-way stretch mesh fabric made of nylon, thereby being useful as sports apparel. The mesh quality of the fabric further holds less water or sweat than other types of clothing material, which also contributes to its use as sports apparel. The tan-through fabric 120 may comprise a honeycomb construction including a large number of closely-spaced holes (having one millimeter in diameter, for example) that allows ultraviolet light to pass through the fabric. FIG. 5 shows a close-up illustration of an example of a tan-through fabric having a honeycomb construction including closely-spaced, hexagon-shaped holes. In one embodiment, the tan-through fabric 120 provides a sun protraction factor of about 5 to about 10.

In one embodiment, the opaque fabric 110 may be composed of a textile, fabric or cloth having moisture-wicking capabilities. The opaque fabric 110 may be composed of interlacing fibers made through weaving, knitting, spreading, crocheting, or bonding. The opaque fabric 110 may comprise a 4-way stretch spandex fabric, having breathable, quick-wicking, and quick-drying qualities. The opaque fabric 110, therefore, may be useful in athletic applications, due to its ability to provide comfort to the wearer by absorbing sweat from the wearer's body and pushing it through to the exterior, where it may evaporate.

Figure 2:
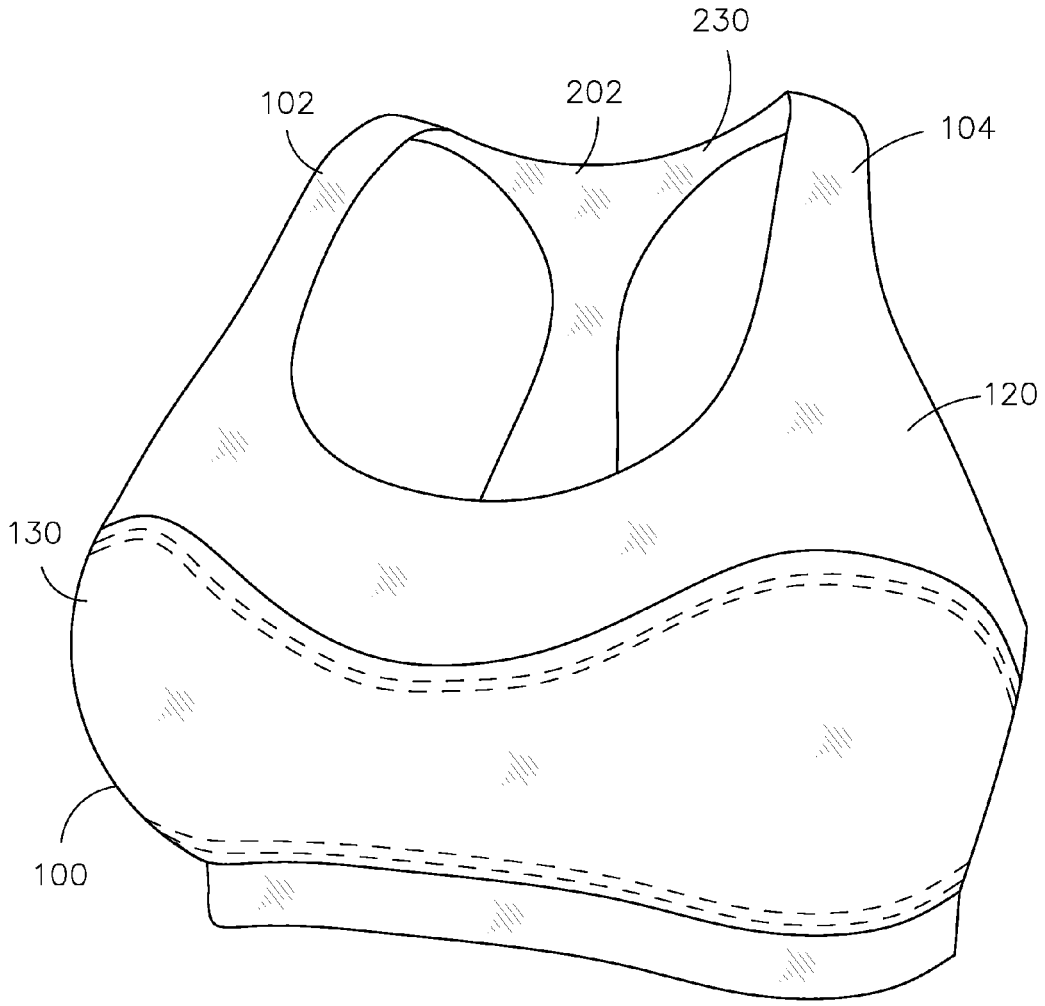
FIG. 2 is an illustration of a frontal view of the sports brassiere of FIG. 1.

FIG. 2 is an illustration of a frontal view of the sports brassiere 100 of FIG. 1. FIG. 2 shows a frontal view of the rear panel 230 of the sports bra 100, which comprises a racer back strap 202. Note that the racer back strap 202 of the rear panel 230 comprises a substantially Y-shaped design wherein the top portions of the Y-shape are coupled with the shoulder straps 102, 104.

Figure 3:
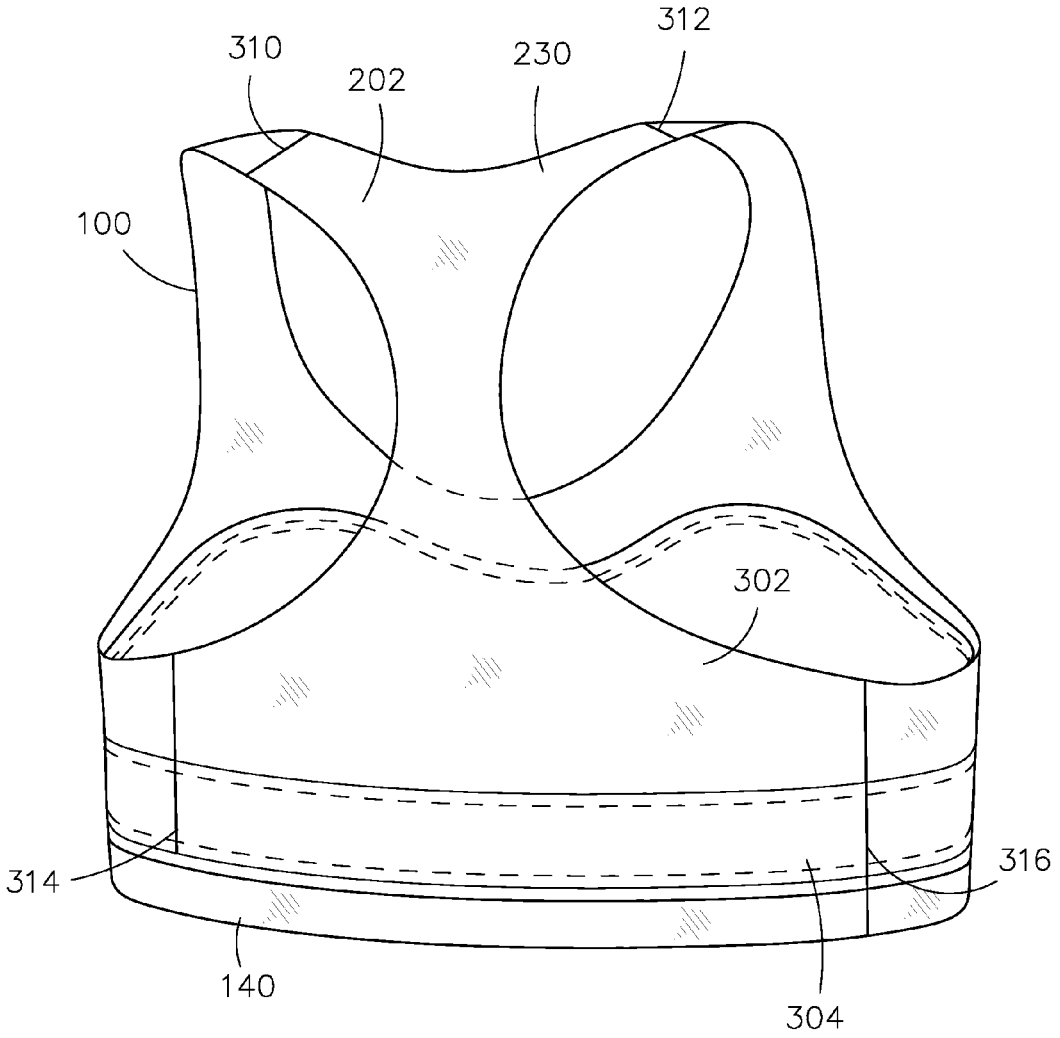
FIG. 3 is an illustration of a rear view of the sports brassiere of FIG. 1.

FIG. 3 is an illustration of a rear view of the sports brassiere 100 of FIG. 1. FIG. 3 more fully shows the racer back strap 202 of the rear panel 230. FIG. 3 shows that rear panel 230 comprises a continuous portion of tan-through fabric 302 that is shaped to include the racer back strap 202 and extends down to the elastic band 140, which is also covered by a portion of tan-through fabric. A lower portion of the rear panel 230 further includes a portion of opaque fabric 304 that is disposed behind the tan-through fabric 302 so as to cover and occlude a portion of the wearer's back. Note the height of the opaque fabric 304 in the rear panel 230 is substantially lower than the height of the tan-through fabric 302.

FIG. 3 also shows a pair of seams 310, 312 wherein the top portions of the Y-shape of the racer back strap 202 meet the shoulder straps 102, 104, respectively. FIG. 3 further shows a pair of seams 314, 316 wherein the lower ends, or side seams, of the rear panel 230 meet the lower ends, or side seams, of the front panel 130. Note that seam 316 extends to include a seam in the elastic band 140 and the fabric covering the elastic band 140 (described in greater detail below).

Figure 4:
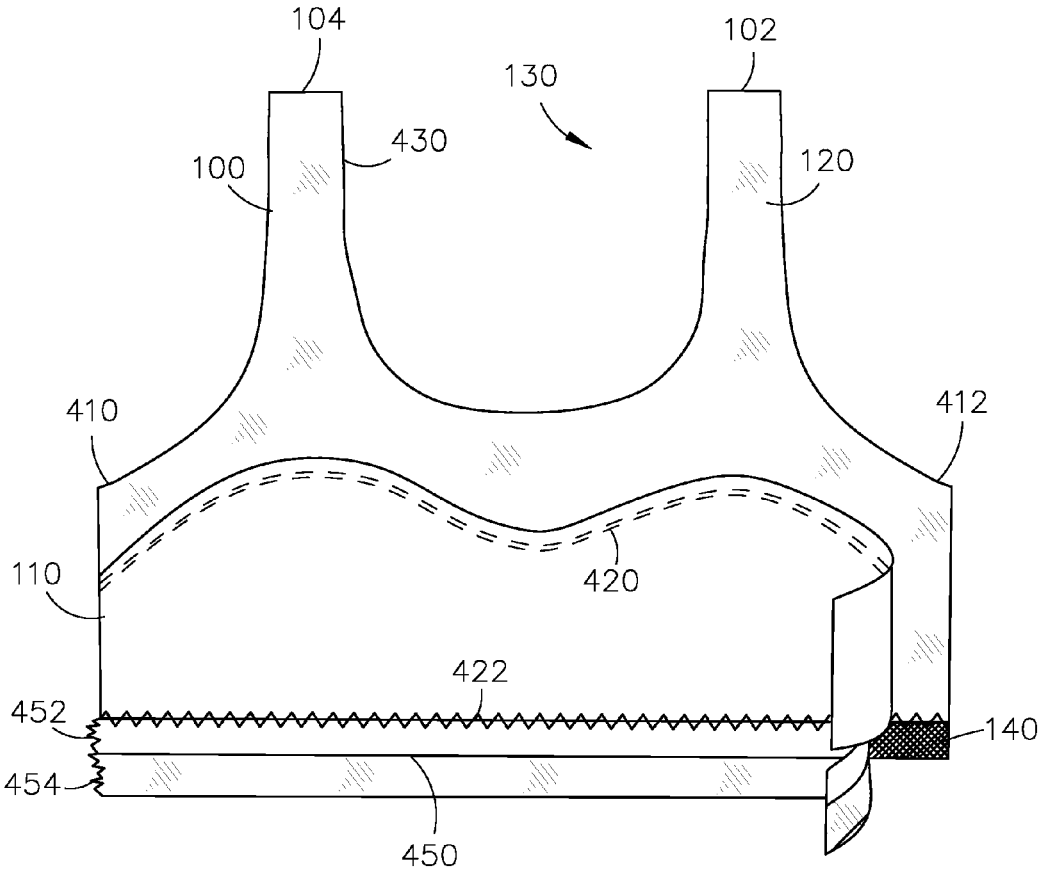
FIG. 4 is an illustration of an interior view of the front panel of the sports brassiere of FIG. 1.

FIG. 4 is an illustration of an interior view of the front panel 130 of the sports bra 100 of FIG. 1. Note that in FIG. 4 the front panel 130 is viewed from the interior of the garment, whereas in FIG. 1 the front panel 130 is viewed from the exterior of the garment. Front panel 130 comprises an interior front panel 110 and an exterior front panel 120. FIG. 4 shows front panel 130 comprising a continuous portion of tan-through fabric 120 that is shaped to include two shoulder straps 102, 104, two side seams 410, 412, and extends down to a fabric casing 450 for the elastic band 140.

A portion of opaque fabric 110 is disposed on top of the tan-through fabric 120 so as to cover and occlude the breasts and nipples. The height of the opaque fabric 110 is lower than the height of the tan-through fabric 120 and that shape of the opaque fabric 110 is limited to covering the breasts and nipples of the wearer. The interior front panel 110 is attached to the continuous portion of the exterior front panel 120 via a stitching 420 that runs along a top border or edge of the opaque fabric 110. The bottom border or edge of the opaque fabric 110 and the bottom border or edge of the tan-through fabric 120 are attached to the casing 450, as well as the elastic band 140, via a stitching 422.

Figure 7:
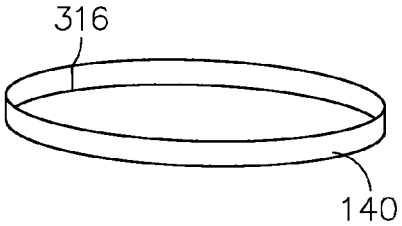
FIG. 7 is an illustration of an elastic band used in connection with the sports brassiere, in accordance with one embodiment of the present invention.

The elastic band 140 provides support under the wearer's breasts and may comprise braid elastic that is shrink resistant, machine washable and dryable. The elastic band 140 may comprise a knit elastic material. FIG. 7 is an illustration of an elastic band 140 showing the seam 316, previously shown in FIG. 3. The casing 450 for the elastic band 140 comprises a strip 452 of opaque fabric coupled with a strip 454 of the tan-through fabric that is folded over the band 140 in order to encase the band 140 to prevent chafing and irritation of the wearer's skin. The strip 452 of opaque fabric is located on the same side (interior) as the opaque fabric 110 and the strip 454 of the tan-through fabric (which is folded over the band 140 in FIG. 4) is located on the same side (exterior) as the tan-through fabric 120. Note the stitching 422 couples the bottom border or edge of the opaque fabric 110 and the bottom border or edge of the tan-through fabric 120 to the casing 450, as well as the elastic band 140.

Figure 6:
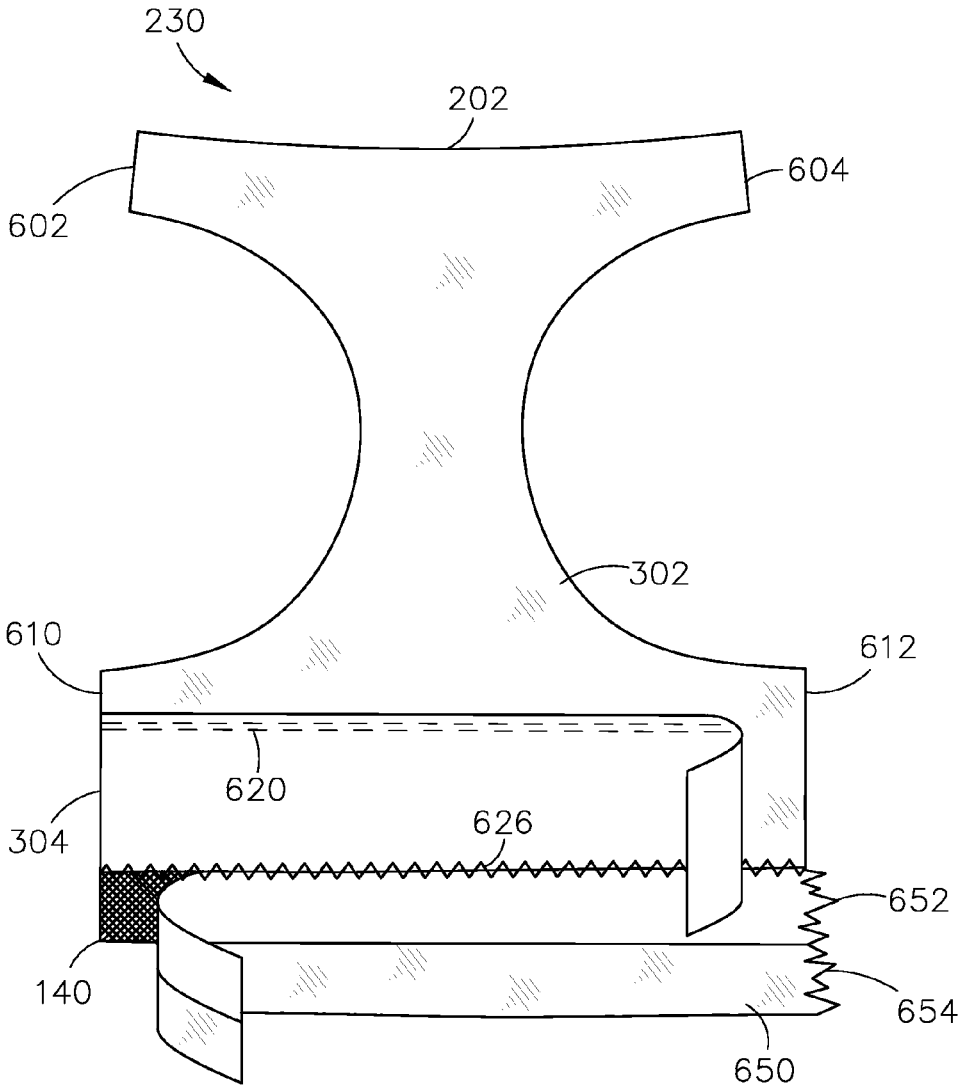
FIG. 6 is an illustration of an interior view of the rear panel of the sports brassiere of FIG. 1.

FIG. 6 is an illustration of an interior view of the rear panel 230 of the sports bra 100 of FIG. 1. Note that in FIG. 4 the rear panel 230 is viewed from the interior of the garment, whereas in FIG. 3 the rear panel 230 is viewed from the exterior of the garment. Rear panel 230 comprises an interior rear panel 304 and an exterior rear panel 302. FIG. 6 shows the racer back strap 202 of the rear panel 230, having top ends 602, 604, which meet the shoulder straps 102, 104, respectively, at seams 310, 312. The rear panel 230 also includes bottom ends 610, 612, which meet the side seams 410, 412, respectively, at seams 314, 316.

The rear panel 230 comprises a continuous portion of tan-through fabric 302 that is shaped to include the racer back strap 202 and extends down to a casing 650 for the elastic band 140. A lower portion of the rear panel 230 further includes a portion of opaque fabric 304 that is disposed on top of the tan-through fabric 302 so as to cover and occlude a portion of the wearer's back. The height of the opaque fabric 304 is substantially lower than the height of the tan-through fabric 302. The interior rear panel 304 is attached to the exterior rear panel 302 via a double stitching 620 that runs along a top border or edge of the opaque fabric 304. The bottom border or edge of the opaque fabric 304 and the bottom border or edge of the tan-through fabric 302 are attached to the casing 650, as well as the elastic band 140, via a stitching 626.

The casing 650 for the elastic band 140 (which is a continuous extension of the casing 450 of FIG. 4) comprises a strip 652 of opaque fabric coupled with a strip 654 of the tan-through fabric that is folded over the band 140 in order to encase the band 140. Note the stitching 626 couples the bottom border or edge of the opaque fabric 304 and the bottom border or edge of the tan-through fabric 302 to the casing 650, as well as the elastic band 140.

In an embodiment of the present invention, the stitching used in one or more of the seams 310, 312, 314, and 316, as well as stitching 620, 626, 420, 422, may comprise woolly thread, polyester thread, or the like. Wooly thread is commonly used in conjunction with stretch garments, as it can stretch to accommodate the fabric. Polyester thread is used various sewing applications, due to its strength and durability.

In one embodiment of the present invention, seams 310, 312, 314, and 316, as well as stitching 620, 626, 420, 422, may comprise a cover stitch. A cover stitch is a stitch well known in the textile art. A cover stitch is formed by two or more needles and one or two loopers. A cover stitch is widely used in garment construction, particularly for attaching trims and flat seaming where the raw edges can be finished in the same operation as forming the seam. In another embodiment of the present invention, seams 310, 312, 314, and 316, as well as stitching 620, 626, 420, 422, may comprise serged stitches. A serged stitch is a stitch well known in the textile art. A serged stitch can be formed with one to four threads, one or two needles, and one or two loopers. Lastly, in one embodiment of the present invention, the distal borders or edges of the tan-through fabric 120 and 302, such as the borders of the arm holes, may be pearl stitched so as to provide a finished edge and reinforce the border of the fabric. A pearl stitch may be a smaller merrow stitch or an overlock stitch.

In further embodiment, the tan-though fabric and/or the opaque fabric may be comprised of a combination of elastic and inelastic fabrics. The tan-though fabric and/or the opaque fabric may further be comprised of any one of a woven material, a natural fiber material, a synthetic fiber material and a blended fiber material. The tan-though fabric and/or the opaque fabric may comprise an elastic fabric such as spandex or elastane, which is a synthetic fiber known for its elasticity. The tan-though fabric and/or the opaque fabric may further comprise a synthetic blend fiber fabric exhibiting elastic characteristics or a substantially inelastic fabric such as woven or non-woven fabric comprising, cotton, cotton blend, synthetic, or synthetic blend of material. Additionally, the tan-though fabric and/or the opaque fabric may be absorbent, thereby allowing for absorbing of sweat or other liquids and reducing or eliminating embarrassing stains on the brassiere.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A brassiere designed for exposing a wearer's skin to ultraviolet light for reducing tan lines, comprising:

an exterior front panel comprising a micromesh fabric substantially transparent to ultraviolet light, wherein the exterior front panel is shaped to include two shoulder straps and two side seams;

an interior front panel comprising an opaque, moisture-wicking fabric having a height limited to covering a wearer's breasts, wherein the interior front panel is coupled to an interior face of the exterior front panel via stitching running along a top edge of the interior front panel;

an exterior rear panel comprising the micromesh fabric, wherein the exterior rear panel is coupled to the exterior front panel via a set of seams located at the two shoulder straps and the two side seams; and an elastic band coupled to a bottom edge of the exterior front panel, a bottom edge of the interior front panel and a bottom edge of the exterior rear panel, wherein the micromesh fabric allows ultraviolet light to pass through the fabric to reduce tan lines.

2. The brassiere of claim 1, wherein the stitching running along a top edge of the interior front panel comprises a wooly thread.

3. The brassiere of claim 2, wherein the elastic band is coupled to the bottom edge of the exterior front panel, the bottom edge of the interior front panel and the bottom edge of the exterior rear panel via a stitching comprising a wooly thread.

4. The brassiere of claim 3, wherein the set of seams include a stitching comprising a wooly thread.

5. The brassiere of claim 4, further comprising a pearl stitching running along a top edge of the exterior front panel.

6. The brassiere of claim 5, wherein the micromesh fabric comprises a honeycomb structure including orifices of about one millimeter in diameter.

7. The brassiere of claim 1, further comprising:

an interior rear panel consisting of the opaque, moisture-wicking fabric having a height substantially lower than a height of the exterior rear panel, wherein the interior rear panel is coupled to an interior face of the exterior rear panel via stitching running along a top edge of the interior rear panel.

8. The brassiere of claim 7, wherein the elastic band is further coupled to a bottom edge of the interior rear panel.

9. The brassiere of claim 8, wherein the stitching running along a top edge of the interior front panel and the stitching running along a top edge of the interior rear panel comprise a wooly thread.

10. The brassiere of claim 8, wherein the elastic band is coupled to the bottom edge of the exterior front panel, the bottom edge of the interior front panel, the bottom edge of the exterior rear panel, and the bottom edge of the interior rear panel via a stitching comprising a wooly thread.

11. The brassiere of claim 10, wherein the set of seams include a stitching comprising a wooly thread.

12. The brassiere of claim 11, further comprising a pearl stitching running along a top edge of the exterior front panel and a top edge of the exterior rear panel.

13. The brassiere of claim 12, wherein the micromesh fabric comprises a honeycomb structure including orifices of about one millimeter in diameter.

14. The brassiere of claim 13, wherein the exterior rear panel comprises a racer back shape.

15. A brassiere designed for exposing a wearer's skin to ultraviolet light for reducing tan lines, comprising:

an exterior front panel comprising a micromesh fabric substantially transparent to ultraviolet light, wherein the exterior front panel is shaped to include two shoulder straps and two side seams;

an interior front panel comprising an opaque, moisture-wicking fabric having a height limited to covering a wearer's breasts, wherein the interior front panel is coupled to an interior face of the exterior front panel via stitching running along a top edge of the interior front panel;

an exterior rear panel comprising the micromesh fabric, wherein the exterior rear panel is coupled to the exterior front panel via a set of seams located at the two shoulder straps and the two side seams;

an interior rear panel consisting of the opaque fabric having a height substantially lower than a height of the exterior rear panel, wherein the interior rear panel is coupled to an interior face of the exterior rear panel via stitching running along a top edge of the interior rear panel; and an elastic band coupled to a bottom edge of the exterior front panel, a bottom edge of the interior front panel, a bottom edge of the exterior rear panel and a bottom edge of the interior rear panel, wherein the micromesh fabric allows ultraviolet light to pass through the fabric to reduce tan lines.

16. The brassiere of claim 15, wherein the stitching running along a top edge of the interior front panel and the stitching running along a top edge of the interior rear panel comprise a wooly thread.

17. The brassiere of claim 16, wherein the set of seams include a stitching comprising a wooly thread.

18. The brassiere of claim 17, wherein the micromesh fabric comprises a honeycomb structure including orifices of about one millimeter in diameter.

19. A brassiere designed for exposing a wearer's skin to ultraviolet light for reducing tan lines, comprising:

an exterior front panel comprising a micromesh fabric substantially transparent to ultraviolet light, wherein the exterior front panel is shaped to include two shoulder straps and two side seams;

an interior front panel comprising an opaque, moisture-wicking fabric having a height limited to covering a wearer's breasts, wherein the interior front panel is coupled to an interior face of the exterior front panel via a double stitched seam running along a top edge of the interior front panel;

an exterior rear panel comprising the micromesh fabric, wherein the exterior rear panel is coupled to the exterior front panel via a set of serged seams located at the two shoulder straps and the two side seams;

an interior rear panel consisting of the opaque fabric having a height substantially lower than a height of the exterior rear panel, wherein the interior rear panel is coupled to an interior face of the exterior rear panel via a double stitched seam running along a top edge of the interior rear panel; and an elastic band coupled to a bottom edge of the exterior front panel, a bottom edge of the interior front panel, a bottom edge of the exterior rear panel and a bottom edge of the interior rear panel via a serged seam, wherein the micromesh fabric allows ultraviolet light to pass through the fabric to reduce tan lines.

* * * * *